US010301887B2

(12) United States Patent
Derkacz et al.

(10) Patent No.: US 10,301,887 B2
(45) Date of Patent: May 28, 2019

(54) DRILL STRING SECTIONS WITH INTERCHANGEABLE COUPLINGS

(71) Applicant: EVOLUTION ENGINEERING INC., Calgary (CA)

(72) Inventors: Patrick R. Derkacz, Calgary (CA); Aaron W. Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 41 days.

(21) Appl. No.: 15/305,953

(22) PCT Filed: May 8, 2015

(86) PCT No.: PCT/CA2015/050415
§ 371 (c)(1),
(2) Date: Oct. 21, 2016

(87) PCT Pub. No.: WO2015/168804
PCT Pub. Date: Nov. 12, 2015

(65) Prior Publication Data

US 2017/0044842 A1 Feb. 16, 2017

Related U.S. Application Data

(60) Provisional application No. 61/990,244, filed on May 8, 2014, provisional application No. 62/004,079, filed on May 28, 2014.

(51) Int. Cl.
*E21B 17/02* (2006.01)
*E21B 17/03* (2006.01)
(Continued)

(52) U.S. Cl.
CPC ..... *E21B 17/042* (2013.01); *E21B 17/043* (2013.01); *E21B 47/011* (2013.01); *E21B 47/122* (2013.01)

(58) Field of Classification Search
CPC ..... E21B 17/02; E21B 17/03; E21B 17/04; E21B 17/042; E21B 17/0423;
(Continued)

(56) References Cited

U.S. PATENT DOCUMENTS 2,112,108 A * 3/1938 Mackenzie ..... F16L 37/252 285/111
2,243,272 A 5/1941 Delbert
(Continued)

FOREIGN PATENT DOCUMENTS

CA 2502154 A1 10/2005
CA 2510435 A1 12/2005
(Continued)

*Primary Examiner* — Cathleen R Hutchins
(74) *Attorney, Agent, or Firm* — Oyen Wiggs Green & Mutala LLP

(57) ABSTRACT

A drill string section includes one or two tool joints that are removable from a body. Tool joints with different thread configurations may be interchangeably used with the same body. The tool joints have a compact construction that can facilitate making the drill string section short. The body overlaps with threads of one or both of the tool joints. The drill string section has non-exclusive application between a mud motor and a drill bit.

30 Claims, 7 Drawing Sheets

(51) Int. Cl.

| | |
|---|---|
| ***E21B 17/04*** | (2006.01) |
| ***E21B 17/042*** | (2006.01) |
| ***E21B 17/043*** | (2006.01) |
| ***E21B 47/01*** | (2012.01) |
| ***E21B 47/12*** | (2012.01) |

(58) Field of Classification Search
CPC ..... E21B 17/0426; F16D 3/22; F16L 15/002; F16L 37/23
See application file for complete search history.

(56) References Cited

U.S. PATENT DOCUMENTS

| | | | | |
|---|---|---|---|---|
| 2,295,720 | A | 9/1942 | Dietzmann et al. | |
| 2,553,985 | A * | 5/1951 | Siracusa | E21B 31/18 285/18 |
| 3,094,852 | A | 6/1963 | Taylor | |
| 3,380,324 | A | 4/1968 | Hillman | |
| 3,434,191 | A | 3/1969 | Timmons | |
| 3,463,247 | A | 8/1969 | Klein | |
| 3,768,579 | A | 10/1973 | Klein | |
| 3,915,243 | A | 10/1975 | Hisey et al. | |
| 3,980,143 | A | 9/1976 | Swartz et al. | |
| 4,023,449 | A | 5/1977 | Boyadjieff | |
| 4,147,215 | A | 4/1979 | Hodge et al. | |
| 4,194,579 | A | 3/1980 | Bailey et al. | |
| 4,240,652 | A | 12/1980 | Wong et al. | |
| 4,335,602 | A | 6/1982 | Walkow | |
| 4,445,265 | A | 5/1984 | Olson et al. | |
| 4,496,174 | A * | 1/1985 | McDonald | E21B 17/003 285/330 |
| 4,520,468 | A | 5/1985 | Scherbatskoy | |
| 4,658,915 | A | 4/1987 | Goris et al. | |
| 4,693,317 | A | 9/1987 | Edwards et al. | |
| 4,844,171 | A | 7/1989 | Russell, Jr. | |
| 5,267,621 | A | 12/1993 | Deken et al. | |
| 5,544,712 | A | 8/1996 | McEwen et al. | |
| 5,740,860 | A | 4/1998 | Crawford et al. | |
| 5,817,937 | A | 10/1998 | Beshoory et al. | |
| 5,996,712 | A | 12/1999 | Boyd | |
| 6,098,727 | A | 8/2000 | Ringgenberg et al. | |
| 6,305,723 | B1 | 10/2001 | Schutz et al. | |
| 6,488,323 | B1 | 12/2002 | Bouligny | |
| 6,499,541 | B1 | 12/2002 | Hiron et al. | |
| 6,845,826 | B1 | 1/2005 | Feld et al. | |
| 7,252,160 | B2 | 8/2007 | Dopf et al. | |
| 7,255,183 | B2 | 8/2007 | Cramer | |
| 7,387,167 | B2 * | 6/2008 | Fraser | E21B 17/028 166/242.1 |
| 7,390,032 | B2 | 6/2008 | Hughes | |
| 7,543,650 | B2 | 6/2009 | Richardson | |
| 8,258,976 | B2 | 9/2012 | Price et al. | |
| 8,308,199 | B2 | 11/2012 | Camwell et al. | |
| 8,376,065 | B2 | 2/2013 | Teodorescu et al. | |
| 8,400,160 | B2 | 3/2013 | Fredette et al. | |
| 8,407,006 | B2 | 3/2013 | Gleitman | |
| 8,648,733 | B2 | 2/2014 | Dopf et al. | |
| 8,695,727 | B2 | 4/2014 | Chau et al. | |
| 8,704,677 | B2 | 4/2014 | Prammer | |
| 2004/0226753 | A1 | 11/2004 | Villareal | |
| 2005/0167157 | A1 | 8/2005 | Boyadjieff | |
| 2006/0089804 | A1 | 4/2006 | Chen et al. | |
| 2006/0225891 | A1 | 10/2006 | Adams et al. | |
| 2007/0063513 | A1 | 3/2007 | Boyd | |
| 2008/0191900 | A1 | 8/2008 | Camwell et al. | |
| 2010/0032210 | A1 | 2/2010 | Teodorescu et al. | |
| 2010/0263495 | A1 | 10/2010 | Webb | |
| 2011/0120269 | A1 | 5/2011 | McCormick et al. | |
| 2011/0180273 | A1 | 7/2011 | Hughes et al. | |
| 2011/0254695 | A1 | 10/2011 | Camwell et al. | |
| 2012/0067649 | A1 | 3/2012 | Wilson | |
| 2012/0085583 | A1 | 4/2012 | Logan et al. | |
| 2012/0137833 | A1 | 6/2012 | Pettit | |
| 2013/0032412 | A1 | 2/2013 | Haugvaldstad et al. | |
| 2013/0120154 | A1 | 5/2013 | Gleitman | |
| 2014/0083773 | A1 | 3/2014 | Minosyan et al. | |
| 2014/0131051 | A1 | 5/2014 | Pratt et al. | |
| 2014/0131994 | A1 | 5/2014 | Holmen et al. | |
| 2014/0150544 | A1 | 6/2014 | Logan et al. | |
| 2015/0114634 | A1 | 4/2015 | Limbacher | |
| 2015/0330155 | A1 * | 11/2015 | Logan | E21B 17/003 166/380 |
| 2017/0044853 | A1 | 2/2017 | Derkacz et al. | |
| 2017/0101829 | A1 | 4/2017 | Heide et al. | |

FOREIGN PATENT DOCUMENTS

| | | | |
|---|---|---|---|
| CA | 2570344 | A1 | 12/2005 |
| CA | 2586317 | A1 | 10/2007 |
| CA | 2699023 | A1 | 10/2010 |
| CA | 2796683 | A1 | 5/2013 |
| GB | 2404401 | A | 2/2005 |
| GB | 2470286 | A | 11/2010 |
| WO | 0109478 | A1 | 2/2001 |
| WO | 2010121345 | A1 | 10/2010 |
| WO | 2014031663 | A1 | 10/2010 |
| WO | 2011049573 | A1 | 4/2011 |
| WO | 2013037058 | A1 | 3/2013 |
| WO | 2014066972 | A1 | 5/2014 |
| WO | 2014075190 | A1 | 5/2014 |

* cited by examiner

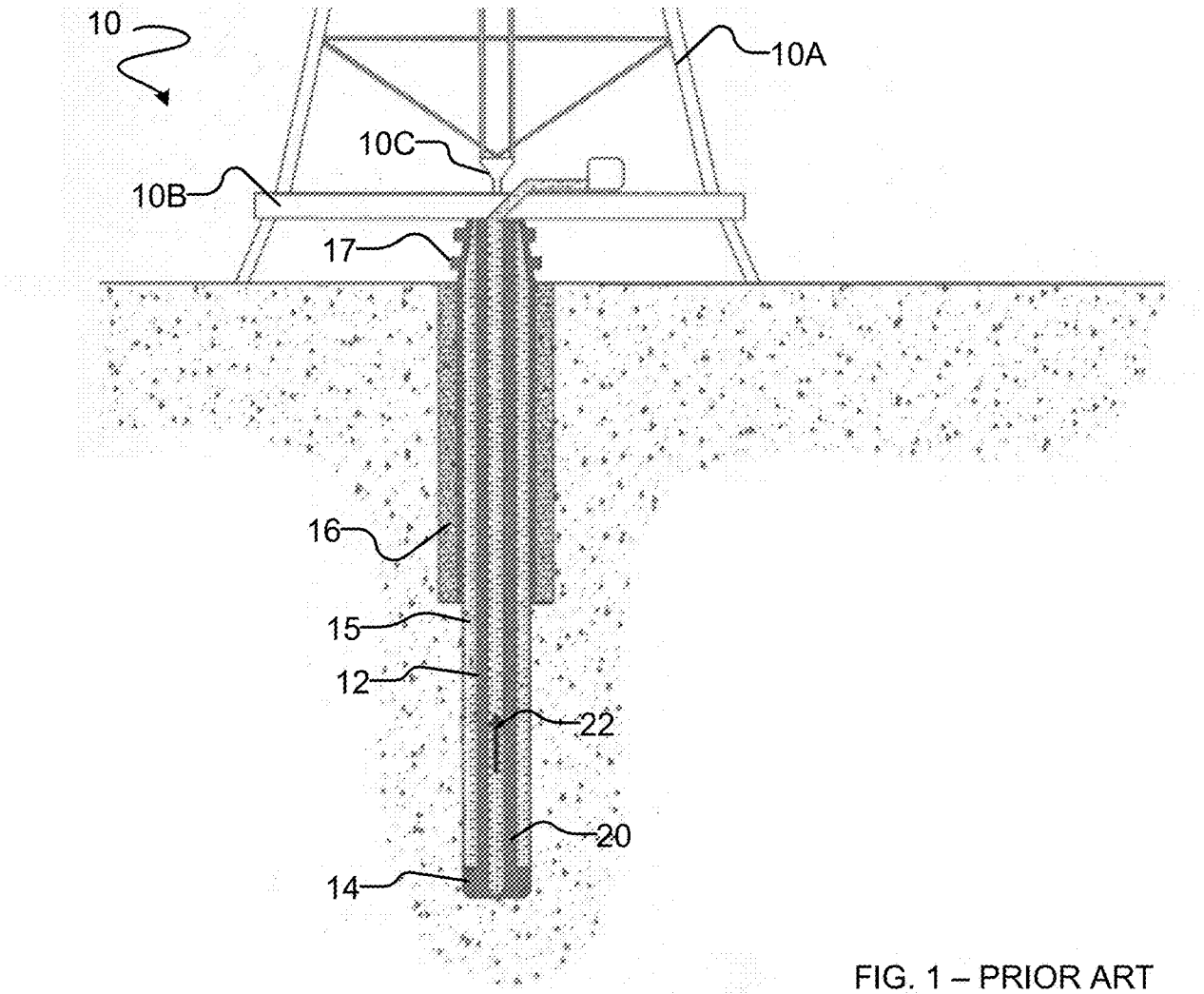
FIG. 1 – PRIOR ART

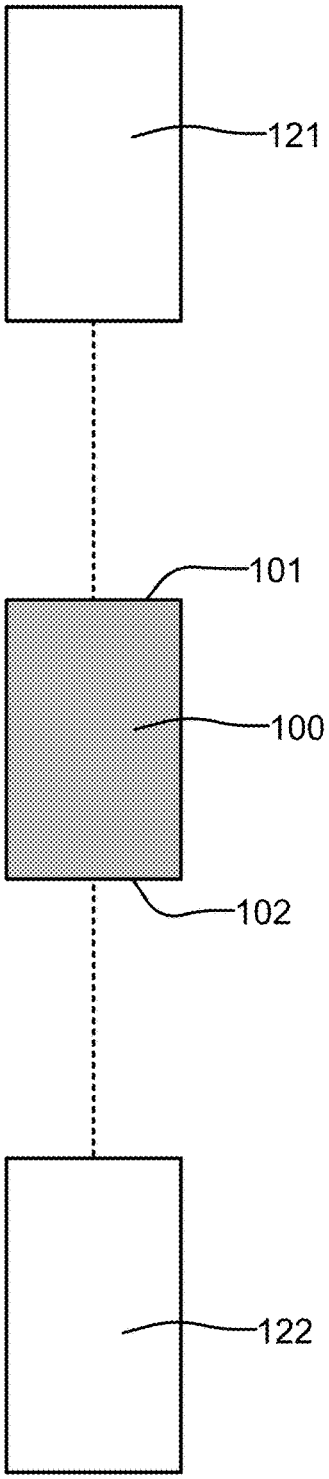
FIG. 2A – PRIOR ART
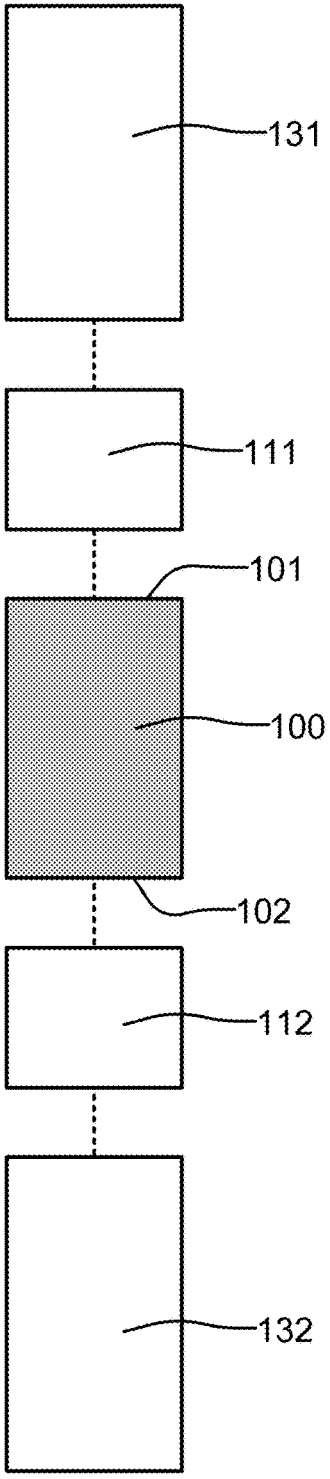
FIG. 2B - PRIOR ART

DRILL STRING SECTIONS WITH INTERCHANGEABLE COUPLINGS

TECHNICAL FIELD

This application relates to drill string sections. In particular, this application relates to drill string sections with interchangeable couplings.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

A typical arrangement for electromagnetic telemetry uses parts of the drill string as an antenna. The drill string may be divided into two conductive sections by including an insulating joint or connector (a "gap sub") in the drill string. The gap sub is typically placed such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

The joints between drill string sections (sometimes called 'tool joints') are made up and taken apart frequently. Over time, this results in the tool joints becoming worn. Eventually the tool joints need to be refurbished. For example, a drill string section may be sent to a machine shop where threaded couplings can be remachined. Drill string sections may be made with extra length so that they can be remachined.

Drill string sections that have replaceable tool joints are described in U.S. Pat. Nos. 4,240,652; 4,445,265; 6,305,723; 6,845,826; 7,390,032; and WO2013037058. Such replaceable tool joints can make it easier to repair the tool joints and may permit field repair of tool joints. A modular drill bit having a replaceable pin coupling is described in US20110120269.

SUMMARY

The invention has a number of aspects. Some aspects provide drill string sections having at least one coupling that is removable so that the coupling can be replaced with other interchangeable couplings. Other aspects provide methods for assembling and installing drill string sections having at least one coupling that is removable and kits comprising drill string sections having at least one coupling that is removable so that the coupling can be replaced and interchangeable couplings having different coupling configurations.

In some embodiments the drill string section comprises a body having an uphole connector and a downhole connector. A coupling such as a pin may be connected to the uphole connector and a coupling such as a box may be connected to the downhole connector. In some embodiments, the pin may comprise male threads and/or the box may comprise female threads.

In some embodiments, the pin and/or the box may each comprise a bore for receiving a part of the body of the drill string section. The pin and/or the box may be attached to the body of the drill string section by one or more of a ball and channel connection, male and female threads, a pinned connection or the like.

In some embodiments, the pin and/or the box may be installed without increasing the axial length of the body of the drill string section. In other embodiments, the pin and/or the box may increase the axial length of the body when installed.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

FIG. 1 is a schematic view of an example prior art drilling operation.

FIGS. 2A and 2B are schematic views of a prior art section of drill string.

DESCRIPTION

Figure 3:
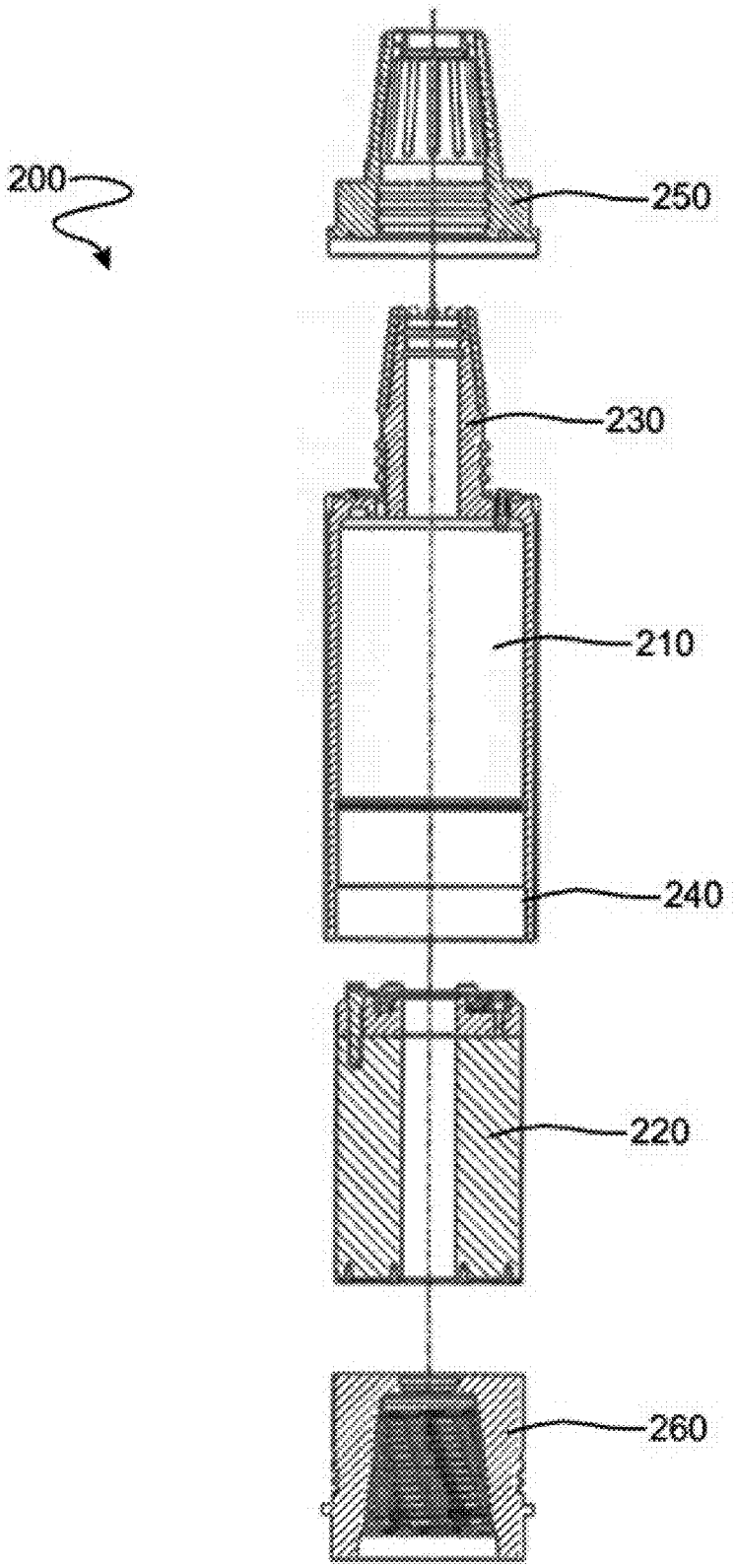
FIG. 3 is a cross-sectional view of a section of drill string according to an example embodiment of the invention.

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

FIG. 1 shows schematically an example prior art drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

FIG. 2A is a schematic view of a prior art drill string section 100. Section 100 has an uphole coupling component 101 and a downhole coupling component 102. Uphole coupling component 101 can be coupled to uphole drill string section 121. Downhole coupling component can be coupled to downhole drill string section 122.

Different parts of a drill string may have different sizes and different types of couplings. The coupling components of section 100 may not match with the coupling components of adjacent sections of drill string. In this case adapters may be used to couple section 100 to the adjacent sections of drill string.

FIG. 2B is a schematic view of prior art section 100 coupled to drill string sections with prior art adapters (also known as "cross-over subs"). An adapter 111 is used to form a coupling between uphole coupling component 101 and uphole drill string section 131. An adapter 112 is used to form a coupling between downhole coupling component 102 and downhole drill string section 132.

FIG. 3 is a cross-sectional view of a drill string section 200 according to an example embodiment of the invention. Section 200 may have any of a variety of functions. For example, section 200 may comprise a mud motor, gap sub, electronics package, cross-over sub, combinations of these, or the like. Section 200 is adaptable to couple to uphole and/or downhole drill string components having different types of couplings. Section 200 has at least one coupling that is removable so that the coupling can be replaced with other interchangeable couplings having different coupling configurations. FIG. 3 shows section 200 in an unassembled configuration. Section 200 comprises a body 210.

The uphole end of body 210 comprises an uphole connector 230. The downhole end of body 210 comprises a downhole connector 240.

Figure 4A:
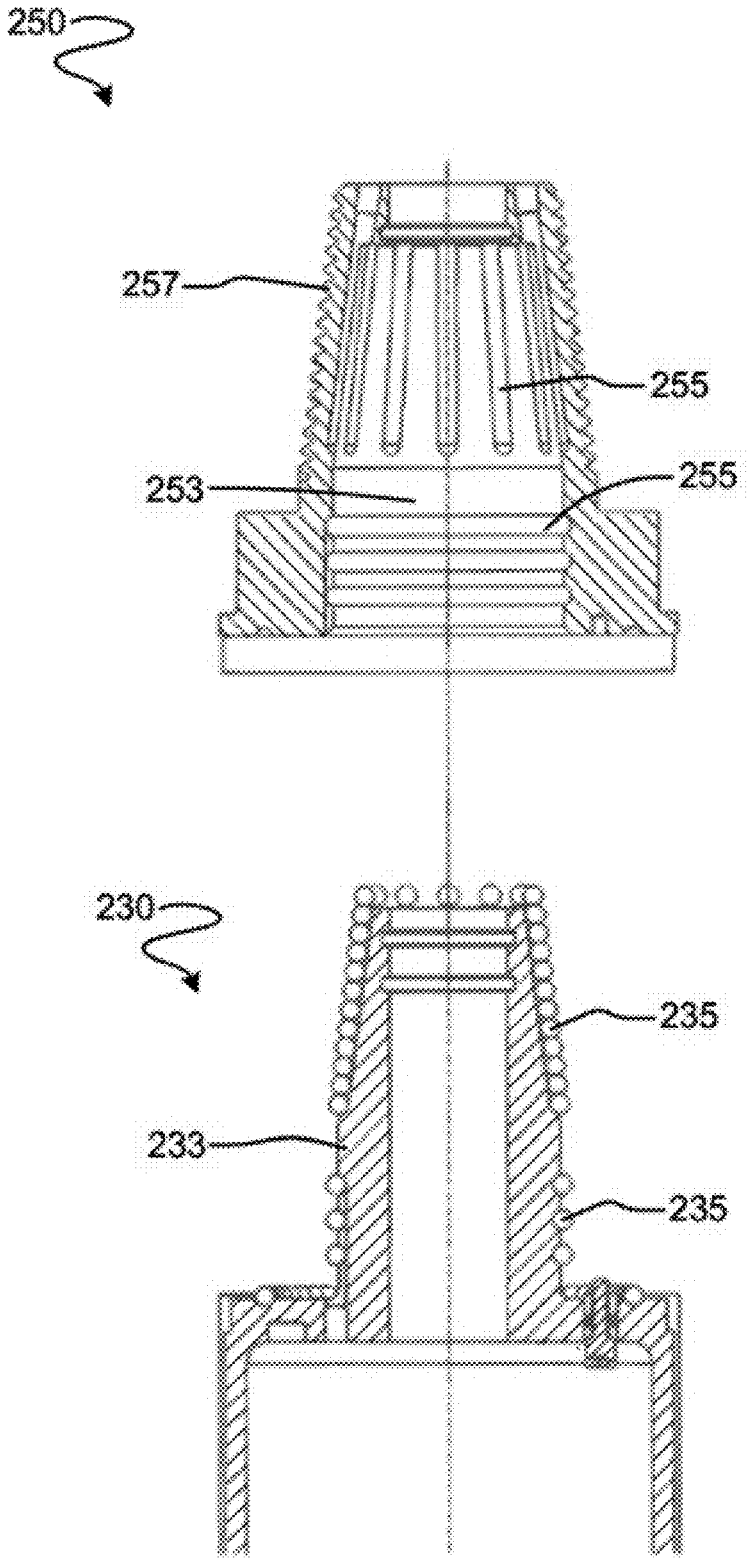
FIG. 4A is a cross-sectional view of the pin and uphole connector shown in FIG. 3 in an unconnected configuration.
Figure 4B:
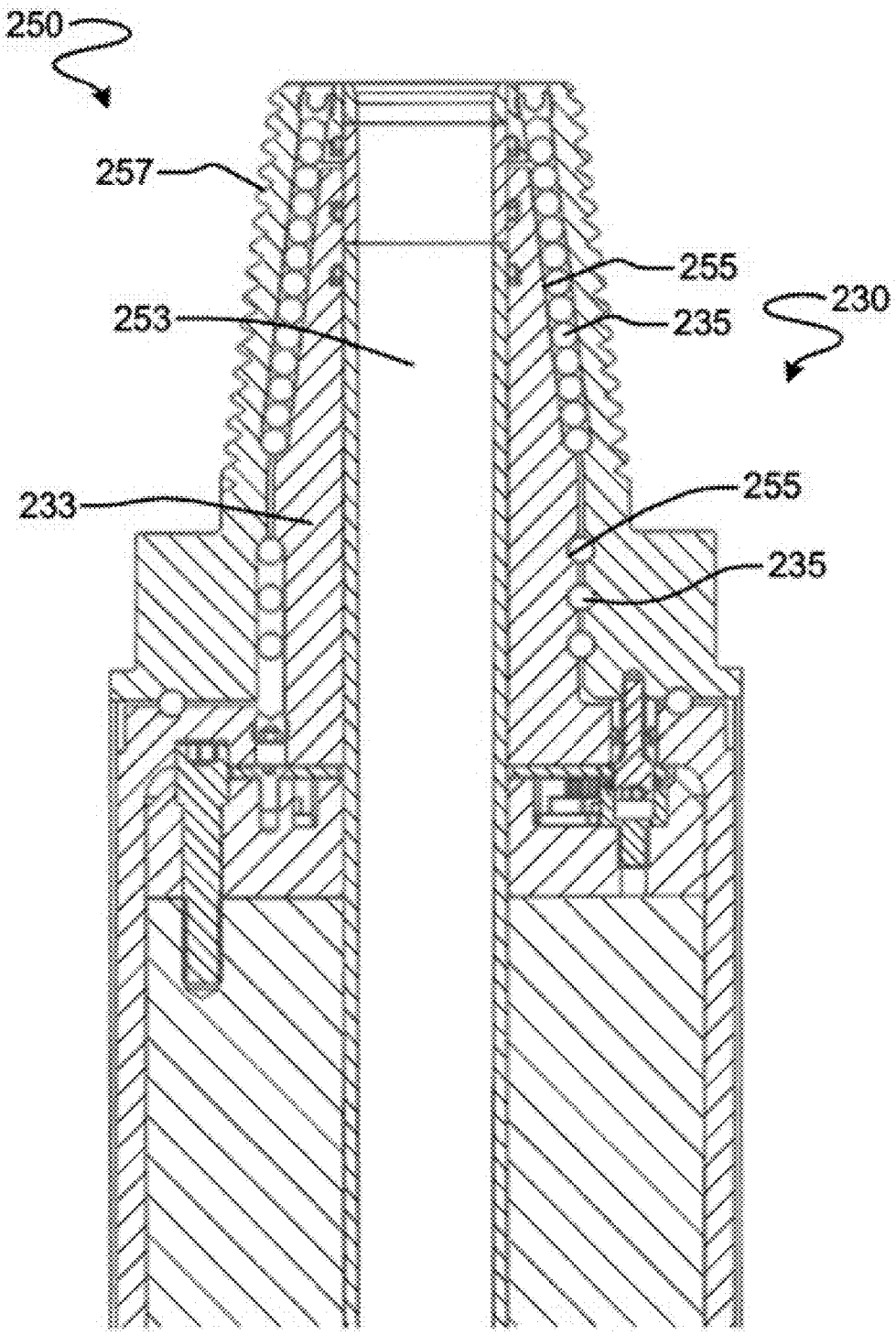
FIG. 4B is a cross-sectional view of the pin and uphole connector shown in FIG. 3 in a connected configuration.

A coupling such as a pin 250 may be connected to uphole connector 230. Uphole connector 230 and pin 250 are shown in greater detail in an unconnected configuration in FIG. 4A and in a connected configuration in FIG. 4B.

Uphole connector 230 comprises a protrusion 233. Pin 250 comprises a bore 253. Pin 250 may be connected to uphole connector 230 by inserting protrusion 233 into bore 253 and then locking pin 250 into place on protrusion 233. In the illustrated embodiment, pin 250 is connected to uphole connector 230 by a "ball and channel" connection. Balls 235 may be placed within channels 255 to prevent pin 250 from being removed from uphole connector 230. Balls 235 may also prevent pin 250 from rotating relative to uphole connector 230. In some embodiments balls 235 are made of an electrically-insulating material and electrically insulate pin 250 from uphole connector 230, thereby forming an insulating gap. For example, balls 235 may be made of a ceramic.

In other embodiments, pin 250 may be connected to uphole connector 230 by another type of connection, for example, a threaded connection or a pinned connection.

Pin 250 may comprise threads 257. Threads 257 may correspond to a particular type of threaded coupling used on a particular section of drill string to which it is desired to attach section 200. A set of different pins 250 may be provided, each with a different thread 257 for coupling to a different type of threaded coupling. Threads 257 of different pins 250 may have different diameter, taper, pitch, cross-sectional shape, etc. Threads 257 may be API threads, ACME threads, etc.

When section 200 needs to be coupled to a particular section of drill string with a particular type of coupling, a pin 250 with appropriate threads may be selected and connected to uphole connector 230 of section 200. Pin 250 may be removed from uphole connector 230 and replaced with a different pin when section 200 needs to be coupled to a different section of drill string with a different type of coupling. Pin 250 may be removed from uphole connector 230, for example, by removing balls 235 from channels 255.

Pin 250 may be replaced if it becomes damaged (e.g. if threads 257 become overly worn or otherwise damaged). Pin 250 may be made of a material that is resistant to galling (e.g. beryllium copper) for enhanced wear-resistance.

In some embodiments, a portion of threads 257 (or all of threads 257) overlap with bore 253 in the axial direction. The overlapping of threads 257 and bore 253 may allow pin 250 to be very compact in the axial direction. In some embodiments, pin 250 is dimensioned so that when it is connected to protrusion 233 it does not extend beyond protrusion 233 in the axial direction (see FIG. 4B, for example). In some embodiments, pin 250 is dimensioned so that when it is connected to protrusion 233 it extends beyond protrusion 233 by no more than ½, ⅓, or ¼ of its length in the axial direction. In some embodiments, when pin 250 is connected to protrusion 233, a portion of threads 257 (or all of threads 257) overlap with protrusion 233 in the axial direction.

Figure 5A:
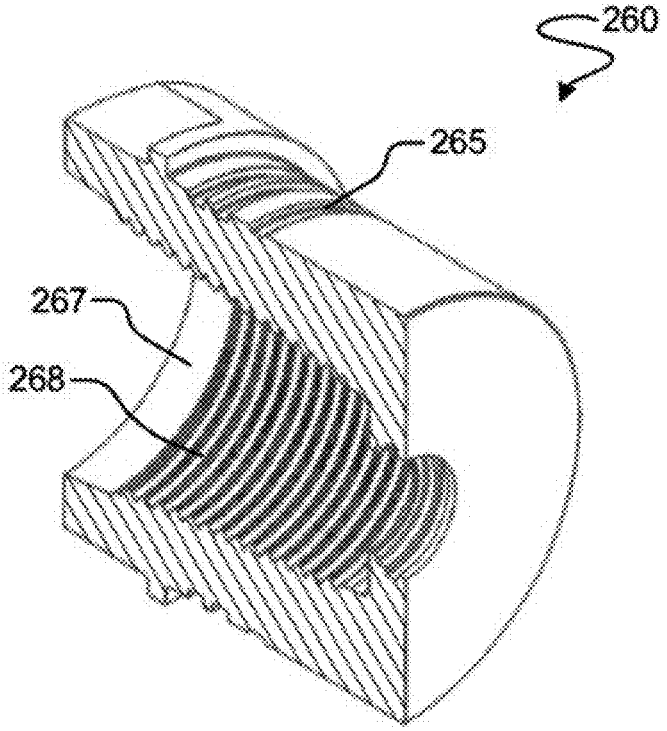
FIG. 5A is a cross-sectional view of the box shown in FIG. 3.
Figure 5B:
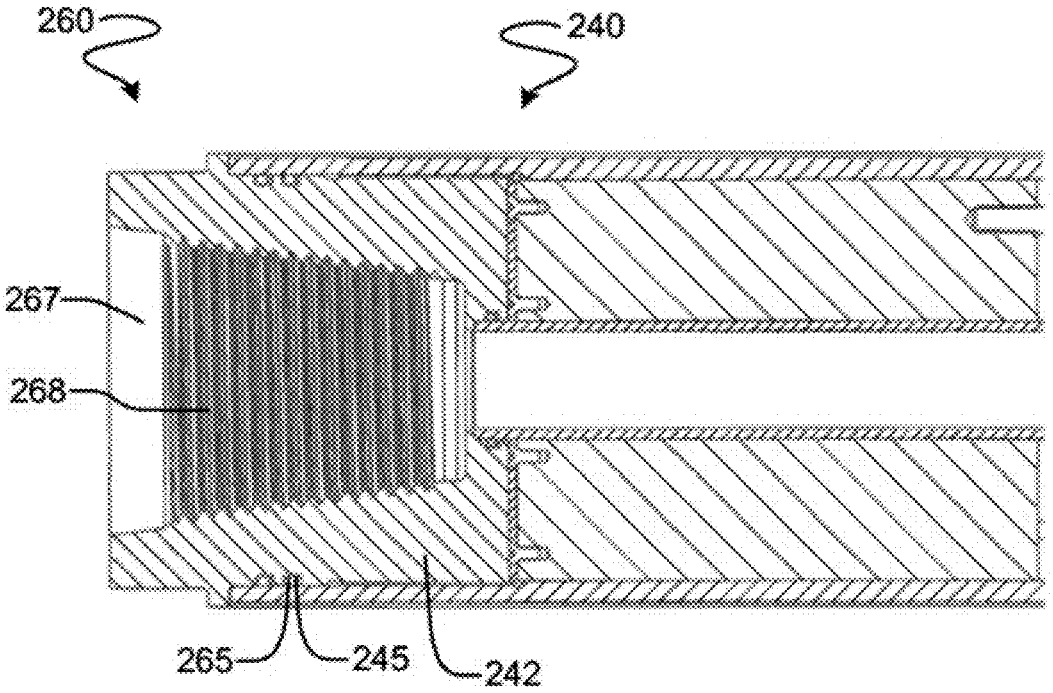
FIG. 5B is a cross-sectional view of the box and downhole connector shown in FIG. 3 in a connected configuration.

A coupling such as a box 260 may be connected to downhole connector 240. Box 260 is shown in greater detail in FIG. 5A. Box 260 and downhole connector 240 are shown in a connected configuration in FIG. 5B.

Box 260 may be inserted into a bore 242 of downhole connector 240. Box 260 may be connected to downhole connector 240 by engaging threads 265 of box 260 with corresponding threads 245 of downhole connector 240. In other embodiments, box 260 may be connected to downhole connector 240 by another type of connection, for example, a "ball and channel" connection or a pinned connection.

Box 260 comprises a bore 267 and threads 268. Threads 268 may correspond to a particular type of threaded coupling used on a particular section of drill string to which it is desired to couple section 200. A set of different boxes 260 may be provided, each with different threads 268 for coupling to a different type of threaded coupling. Different threads 268 of different boxes 260 may have different diameter, taper, pitch, cross-sectional shape, etc. Threads 268 may be API threads, ACME threads, etc.

When section 200 needs to be coupled to a particular section of drill string with a particular type of coupling, a box 260 with appropriate threads may be selected and connected to downhole connector 240 of section 200. Box 260 may be removed from section 200 and replaced with a different box if section 200 needs to be coupled to a different section of drill string with a different type of coupling. Box 260 may be removed from downhole connector 240, for example, by unscrewing box 260 from downhole connector 240.

Box 260 may be replaced if it becomes damaged (e.g. if threads 265 or threads 268 become overly worn or otherwise damaged). Box 260 may be made of a material that is resistant to galling (e.g. beryllium copper) for enhanced wear-resistance.

In some embodiments, a portion of threads 265 (or all of threads 265) overlap with threads 268 in the axial direction. The overlapping of threads 265 and threads 268 may allow box 260 to be very compact in the axial direction. In some embodiments, box 260 is dimensioned so that when it is connected to downhole connector 240 it does not extend beyond bore 242 in the axial direction. In some embodiments, box 260 is dimensioned so that when it is connected to downhole connector 240 it extends beyond bore 242 by no more than ½, ⅓, or ¼ of its length in the axial direction (see FIG. 5B, for example). In some embodiments, when box 260 is connected to downhole connector 240 a portion of threads 268 (or all of threads 268) overlap with bore 242 in the axial direction.

Body 210 of section 200 may comprise a housing for an equipment package 220. Equipment package 220 may be inserted into body 210 and secured therein. Equipment package 220 may comprise any type of downhole equipment, including sensors, telemetry tools, etc. Before box 260 is connected to downhole connector 240, equipment package 220 may be inserted into body 210. Box 260 may secure equipment package 220 within body 210. O-rings or other seals may be provided to seal equipment package 220 within body 210. These seals may prevent drilling fluid from entering the space between equipment package 220 and box 260. Box 260 may be removed in order to remove equipment package 220 from body 210 (for repair, replacement, etc.).

In the embodiment illustrated in FIG. 3, uphole connector 230 comprises a protrusion 233 and downhole connector 240 comprises a bore 242. In other embodiments, uphole connector 230 comprises a bore and downhole connector 240 comprises a protrusion. In other embodiments, both uphole connector 230 and downhole connector 240 comprise protrusions. In other embodiments, both uphole connector 230 and downhole connector 240 comprise bores.

In the embodiment illustrated in FIG. 3, section 200 comprises a pin at its uphole end and a box at its downhole end. In other embodiments, section 200 comprises pins at both ends or boxes at both ends. In other embodiments, section 200 comprises a box at its uphole end and a pin at its downhole end.

Section 200 may be provided with sets of pins 250 and boxes 260 with different types of threads for coupling to different types of threaded connectors of sections of drill string. A section and a set of two or more pins and/or two or more boxes may be provided as a kit.

Figure 6A:
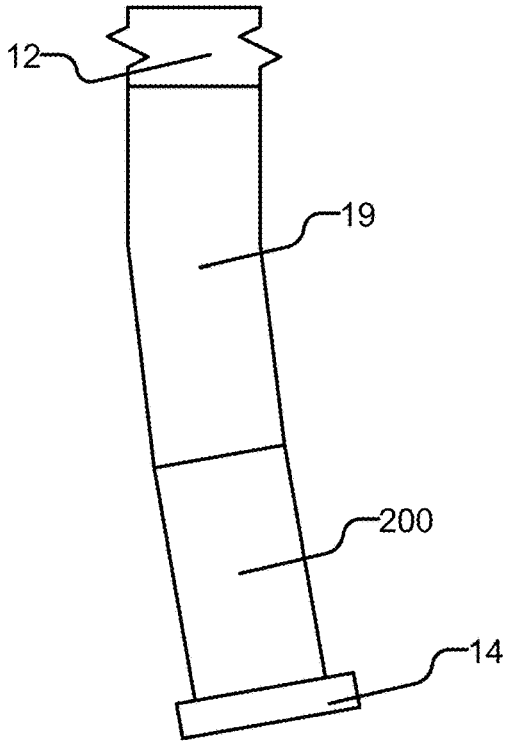
FIG. 6A is a schematic view of the drill string section shown in FIG. 3 connected between a drill bit and a bent section of a drill string.
Figure 6B:
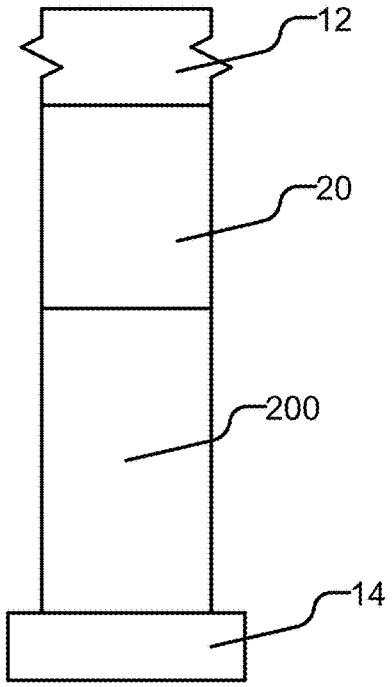
FIG. 6B is a schematic view of the drill string section shown in FIG. 3 connected between a mud motor and a drill bit.

Pin 250 and box 260 may be significantly shorter than prior art adapters 111 and 112, and thus section 200 may be shorter than section 100. In directional drilling applications where section 200 forms a part of the drill string between the drill bit 14 and the bend 19 in the drill string (as shown schematically in FIG. 6A), it is advantageous for section 200 to be relatively short to permit greater control of the drilling direction. It is particularly beneficial for drill string section 200 to be short when section 200 is coupled between a mud motor 20 and drill bit 14, as shown schematically in FIG. 6B. Note that the relative sizes of the parts shown in FIGS. 6A and 6B are not to scale.

In some embodiments a section like section 200 has an overall length that does not exceed 2 feet (about 60 cm) or 3 feet (about 90 cm) for example.

While a number of exemplary aspects and embodiments have been discussed above, those of skill in the art will recognize certain modifications, permutations, additions and sub-combinations thereof.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A drill string section comprising:

a body having tool joints at either end thereof for connections to other drill string sections;

wherein a first end of the body comprises:

a projection formed integrally with the body;

a coupling surface extending radially outwards from the projection to an outer diameter of the drill string section; and a first one of the tool joints axially fixed to the projection wherein the first one of the tool joints is non-rotationally and removably coupled to the projection and the coupling surface of the body, wherein the first tool joint comprises:

a flange adjacent the coupling surface; and a threaded coupling for coupling to one of the other drill string sections, the threaded coupling having a diameter smaller than the flange and extending longitudinally from the flange to an end of the first tool joint, wherein the threaded coupling is longer than the flange in a direction longitudinal to the body; and wherein the projection of the body extends into a bore of the first tool joint and longitudinally overlaps with the threaded coupling for at least one half of a length of the threaded coupling;

the first tool joint is retained on the body by engagement of members located inside the bore of the first tool joint with the projection of the body; and circumferential grooves are formed on an outer surface of the projection of the body and the first tool joint is retained on the body by the members that extend between the circumferential grooves and corresponding recesses in the bore of the first tool joint.

2. The drill string section according to claim 1 wherein the threaded coupling is a tapered pin coupling.

3. The drill string section according to claim 1 wherein the members comprise balls.

4. The drill string section according to claim 3 wherein the balls prevent relative rotation between the first tool joint and the body by extending between the circumferential grooves and corresponding recesses.

5. The drill string section according to claim 3 wherein the balls are made of an electrically-insulating material.

6. The drill string section according to claim 1 wherein the recesses in the bore of the first tool joint comprise circumferential grooves.

7. The drill string section according to claim 1 wherein an outside diameter of the projection of the body is smaller than an inside diameter of the bore of the first tool joint such that the first tool joint is spaced apart from the projection of the body by an annular gap.

8. The drill string section according to claim 7 wherein the first tool joint is electrically insulated from the body.

9. The drill string section according to claim 1 wherein the second one of the tool joints is removable from the body.

10. The drill string section according to claim 9 wherein the second one of the tool joints comprises a second threaded coupling for coupling to another one of the other drill string sections.

11. The drill string section according to claim 10 wherein the body longitudinally overlaps with the second threaded coupling of the second tool joint for at least one half of a length of the second threaded coupling.

12. The drill string section according to claim 10 wherein the second threaded coupling of the second tool joint comprises a box connection.

13. The drill string section according to claim 10 wherein the second one of the tool joints is received in a bore in the body.

14. The drill string section according to claim 13 wherein an outer surface of the second tool joint and an inner surface of the bore of the body each carry complementary threads and the second tool joint is in threaded engagement in the bore of the body.

15. The drill string section according to claim 14 wherein the threads on the outer surface of the second tool joint overlap longitudinally with a threaded area of the second threaded coupling.

16. The drill string section according to claim 15 wherein the second tool joint comprises a radially-projecting flange that abuts against an end of the body when the second tool joint is fully in threaded engagement in the bore of the body.

17. The drill string section according to claim 10 in combination with a set comprising a plurality of the second tool joints which are interchangeably and removably affixable to the body wherein in different ones of the second tool joints the second threaded coupling of the second tool joint has different configurations.

18. The drill string section according to claim 17 comprising a downhole electronics package in the chamber.

19. The drill string section according to claim 18 wherein the downhole electronics package comprises an electromagnetic telemetry transmitter.

20. The drill string section according to claim 9 comprising a chamber within the body, the chamber accessible by removing the second tool joint from the body.

21. The drill string section according to claim 1 in combination with a set comprising a plurality of the first tool joints which are interchangeably and removably affixable to the body wherein in different ones of the first tool joints the threaded coupling of the first tool joint has different configurations.

22. The drill string section according to claim 1 wherein the body is tubular and the drill string section provides a fluid flow passage extending longitudinally through the drill string section.

23. The drill string section according to claim 1 wherein the drill string section has an overall length not exceeding 2 feet (about 60 cm).

24. The drill string section according to claim 1 in combination with a drill string wherein the drill string section is coupled into the drill string between a mud motor and a drill bit.

25. The drill string section according to claim 1 in combination with a drill string wherein the drill string section is coupled into the drill string between a bend in the drill string and a drill bit.

26. The drill string section according to claim 1 wherein the first tool joint threadedly engages the projection of the body.

27. The drill string section according to claim 26 wherein the threaded engagement prevents relative rotation between the first tool joint and the body.

28. The drill string section according to claim 1 wherein the first tool joint engages the projection of the body through a pinned connection.

29. The drill string section according to claim 28 wherein the pinned connection prevents relative rotation between the first tool joint and the body.

30. The drill string section according to claim 1 wherein the members prevent relative rotation between the first tool joint and the body.

* * * * *